US006199832B1

(12) United States Patent
Morrow

(10) Patent No.: US 6,199,832 B1
(45) Date of Patent: Mar. 13, 2001

(54) COLUMN AND PANEL CONCRETE FENCE

(76) Inventor: Brian Morrow, 670 E. 3750 North, Provo, UT (US) 84604

( * ) Notice: Subject to any disclaimer, the term of this patent is extended or adjusted under 35 U.S.C. 154(b) by 0 days.

(21) Appl. No.: 08/828,646

(22) Filed: Mar. 31, 1997

(51) Int. Cl.[7] ..... E04H 17/14

(52) U.S. Cl. ..... 256/19; 256/1; 256/24; 52/169.9

(58) Field of Search ..... 256/1, 13.1, 19, 256/24, 31, 73; 52/169.9, 169.4, 169.2, 295

(56) References Cited

U.S. PATENT DOCUMENTS

| | | | | |
|---|---|---|---|---|
| 1,714,949 | * | 5/1929 | Collier et al. | 256/19 X |
| 2,574,711 | * | 11/1951 | Rose | 256/19 |
| 3,193,255 | * | 7/1965 | Burdett | 256/19 |
| 3,503,589 | * | 3/1970 | Moore | 256/19 |
| 3,512,759 | * | 5/1970 | Resler | 256/19 |
| 3,555,751 | * | 1/1971 | Thorgusen | 52/169.9 X |
| 3,617,028 | * | 11/1971 | Bach | 256/19 |
| 4,037,788 | * | 7/1977 | Riley | 256/1 X |
| 4,193,584 | * | 3/1980 | Wieser | 256/19 |
| 4,605,090 | * | 8/1986 | Melfi | 181/210 |
| 5,100,107 | * | 3/1992 | Latta | 256/19 |
| 5,218,797 | * | 6/1993 | Kruse | 52/169.9 |
| 5,404,685 | * | 4/1995 | Collins | 256/19 X |
| 5,501,057 | * | 3/1996 | Dawson | 256/19 X |
| 5,509,249 | * | 4/1996 | House et al. | 52/745.1 |
| 5,524,405 | * | 6/1996 | Byrd | 256/19 X |
| 5,623,797 | * | 4/1997 | Gravier et al. | 256/19 X |
| 5,649,689 | * | 7/1997 | Wilson | 256/19 X |

* cited by examiner

*Primary Examiner*—Bruce A. Lev
(74) *Attorney, Agent, or Firm*—Thompson E. Fehr

(57) ABSTRACT

A column and panel concrete fence includes two or more columns, each of which comprises two portions which are separated from one another along one or more planes that are essentially parallel to the longitudinal axis of the column. The columns are placed upon footings, as also are the ends of concrete panels which run between successive columns. Preferably, the panels are composed of two or more panel units which are mirror images of one another.

11 Claims, 7 Drawing Sheets

COLUMN AND PANEL CONCRETE FENCE

BACKGROUND OF THE INVENTION

1. Field of the Invention

This invention relates to fencing composed of concrete columns and panels and a method for constructing such fencing.

2. Description of the Related Art

Several patents exist for column and panel concrete fencing.

U.S. Pat. No. 4,193,584 of Joseph H. Wieser utilizes concrete columns or posts having slots for receiving concrete panels between the posts.

Since the columns of U.S. Pat. No. 4,193,584 are solid structures, they are necessarily quite heavy. Moreover, when they are cast, at least one side must necessarily be adjacent to the mold and, therefore, has a rough, aesthetically displeasing outer surface. The disadvantage of weight and rough appearance also exists for the panels.

Moreover, there appears to be no means of directly connecting steel reinforcing rods in the panels to steel reinforcing rods in the columns to meet seismic building codes, although an external strap does loosely connect panels to columns.

The concrete noise barrier in U.S. Pat. No. 4,605,090 of Nicholas W. Melfi, similarly has solid columns and panels. The problem with weight is alleviated somewhat for the panels by dividing each panel about a horizontal plane. No similar remedial technique is, however, employed for the columns. And the aesthetic difficulty has not been solved.

Again, no means is provided for connecting reinforcing rods in the panels to reinforcing rods in the columns. Even the loose external strap of U.S. Pat. No. 4,193,584 is not employed to assist with seismic safety.

The barrier in U.S. Pat. No. 5,509,249 consists essentially of a series of Z-shaped sections that can be connected to one another. There is no true column, although the ends of each section—when connected to the ends of successive section—create a structure that resembles a column. Having, thus, essentially combined the panel and the column into a single unit, the problem with weight has been exacerbated, even though some remediation may occur through the division of the sections along horizontal planes, in a manner similar to that of U.S. Pat. No. 4,605,090. There is, however, no mitigation for the aesthetic problem when the sections are formed from concrete.

Moreover, the sections cannot attain the appearance of a traditional fence; they must be joined in a zigzag fashion. Nor can adjoining sections, because of the U-shaped configuration for edge surfaces 30 and 38, meet one another at an angle of 90° or less. Additionally, there appears to be no way to connect reinforcing rods in the sections to reinforcing rods extending from the footing 118 in order to meet seismic building codes. Finally, no handling devices to facilitate construction of the barrier wall are described; and the angling of sections of the wall toward the automobile depicted in FIG. 8 demonstrate that, in a collision between the wall and the car, unless the car turns more than 45° toward the wall, there would be a greater component of force exerted by the car against the wall than the car would exert against a standard fence which is built parallel to the highway.

SUMMARY OF THE INVENTION

The Column and Panel Concrete Fence of the present invention has columns which consist of two portions initially separated from one another along one or more planes that are essentially parallel to the longitudinal axis of the column. This permits the portions to be cast so that no rough surface will face outward from the fence when installation of the Column and Panel Concrete Fence has been completed, creating an aesthetically pleasing appearance.

Also, having each column initially divided into portions or halves creates less heavy objects which can be more easily manipulated during installation.

Similarly, the panels preferably consist of two identical panel units, except for the fact that they will be cast as mirror images of one another so that the rough side of one panel unit will face the rough side of the other panel unit that is to be located between the same two columns as is the first panel unit. This creates the same advantages concerning aesthetics and weight as does having the column initially divided into portions or halves.

Having the column initially divided into portions or halves facilitates connecting reinforcing rods (metal projections) in such portions to a reinforcing rod (metal bar) rising from the footing. This division similarly facilitates attaching the reinforcing rods from a panel to reinforcing rods (metal bars) rising from the footing or to reinforcing rods in a panel on the opposite side of the column from the first panel or to both rods from the footing and in the other panel.

The Column and Panel Concrete Fence of the present invention can, moreover, have adjacent panels make almost any desired angle with respect to one another and can have the finished appearance of a traditional fence.

DESCRIPTION OF THE PREFERRED EMBODIMENT

Figure 1:
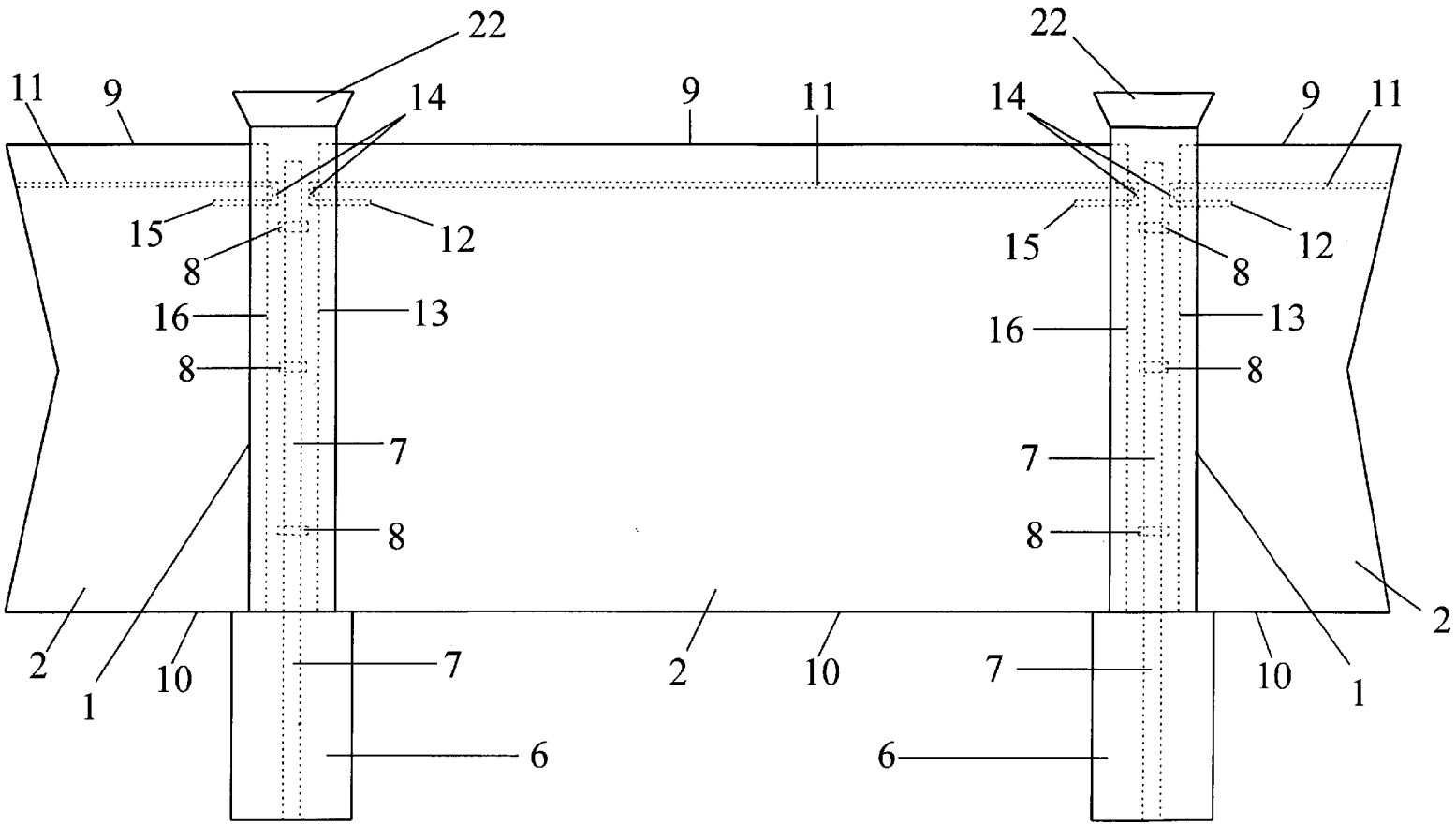
FIG. 1 illustrates the overall Column and Panel Concrete Fence.

As depicted in FIG. 1, the Column and Panel Concrete Fence has two or more columns 1 and one or more panels 2.

Figure 2:
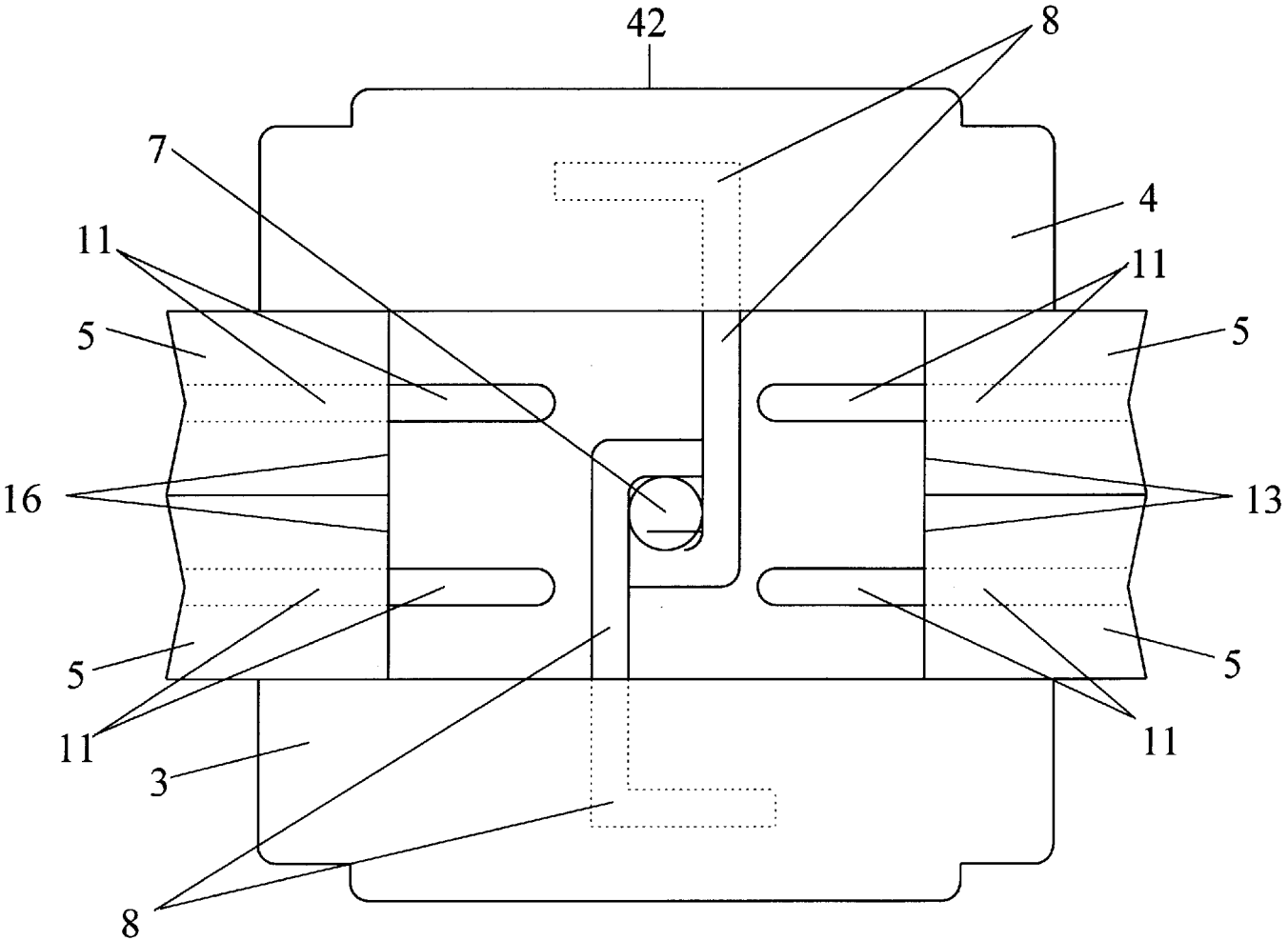
FIG. 2 is a view looking down from above a standard column.

It is evident from FIG. 2 that each column 1 initially comprises two portions which are separated from one another along one or more planes that are essentially parallel to the longitudinal axis of the column 1 so that the column 1 is composed of a first half 3 and a second half 4, which first half 3 and second half 4 are preferably identical to one another. Casting the column 1 in halves, rather than as a single piece, creates a first half 3 and a second half 4 each of which is light enough that such first half 3 and such second half 4 can be carried and manipulated by a single worker. Moreover, casting the column 1 in halves permits horizontal, as opposed to the more difficult vertical, casting.

The panels 2 consist of one or more panel units 5; preferably, each panel 2 is composed of two panel units 5, as illustrated in FIG. 2. It is preferable to have two or more panel units 5 because then, just as with the first half 3 and the second half 4 of the column 1, all rough sides from the casting can be hidden from view. To accomplish this, when a panel 2 consists of two panel units 5, each panel unit 5 of a given panel 2 will be cast as the mirror image of the other panel unit 5 for that panel 2 so that the rough side of one panel unit 5 will face the rough side of the other panel unit 5.

A concrete footing 6, shown in FIG. 1, is placed at a desired location in the ground to support each column 1. Bound within and rising from each such footing 6 is a metal bar 7, which is preferably number 8 rebar. Prior to hardening of the concrete in the footing 6, this metal bar 7 can easily be plumbed so that it will stand vertically after the concrete in the footing 6 has hardened.

Both the first half 3 and the second half 4 of each column 1 have embedded within and extending generally normal to the surface of each such first half 3 or second half 4 which will be installed facing the metal bar 7, one or more metal projections 8.

Either the first half 3 or the second half 4 is placed on the footing 6. Then the metal projections of such first half 3 or second half 4 are attached, preferably by spot welding, to the metal bar 7 rising form the footing 6 to prevent movement of such first half 3 or second half 4.

Toward a first edge 9 of each panel unit 5, i.e., nearer such first edge 9 than a second edge 10 of each panel unit 5, imbedded in each panel unit 5 is a rod 11. A first end 12 of the rod 11 extends from a first end 13 of each panel unit 5 before curving and re-entering the first end 13 of the panel unit 5 to form a hook 14. A second end 15 of the rod 11 follows a similar course at a second end 16 of the panel unit 5 to create a hook 14 on the second end 16 of the panel unit 5.

Figure 3:
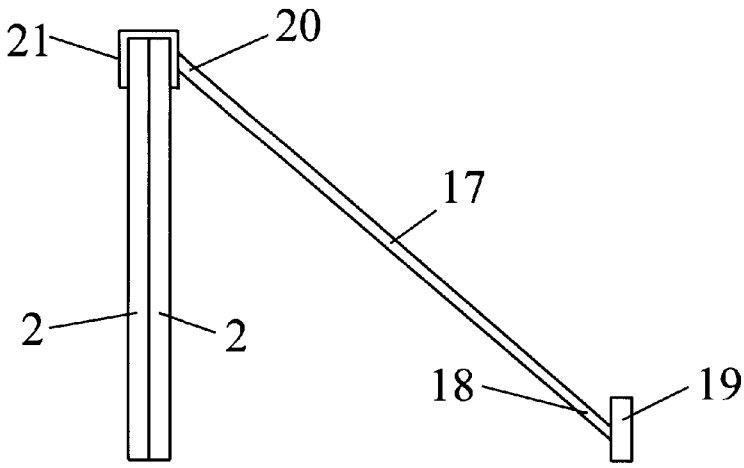
FIG. 3 demonstrates a method for retaining the panels in place during the construction of the Column and Panel Concrete Fence.

Once either the first half 3 or the second half 4 of the column 1 for two adjacent columns 1 has been placed on the footing 6 [It is preferable but not essential to install the same half, i.e., either first half 3 or second half 4 in the case of each adjacent column.], the desired number of panel units 5 are put, preferably with a forklift, on the footings 6 for the adjacent columns 1 so that there is some overlapping between either the first half 3 or the second half 4 and the panel units 5. As illustrated in FIG. 3, until the two adjacent columns 1 have been completed, the panel units 5 are retained in place by a brace 17, which is preferably a galvanized pipe, that is attached at a first end 18 to a stake 19, which is preferably metal and which is driven into the ground, and is connected at a second end 20 to a bracket 21 which is removably attached to the panel units 5.

When the panel units 5 are in place between adjacent columns 1, the half 3 or 4 of the column 1 which had not already been installed is put in the approximate position where it is to be located on the resultant column 1, with some overlapping of the panel units 5. Each metal projection 8 is preferably shaped with both of its ends turned approximately perpendicularly to the body of the metal projection 8. The end of the metal projection 8 which is not embedded in the half 3 or 4 of the column 1 is oriented so that upon installation such end will, also, be oriented approximately perpendicularly to the metal bar 7. Thus, when the later of the two halves 3 or 4 is initially placed near its final position in the resultant column 1, such half 3 or 4 is offset from the metal bar 7 in the direction away from which the end of the metal projection 8 that is not embedded in the half 3 or 4 is turned. This permits the end of the metal projection 8 that is not embedded within the half 3 or 4 to be moved to the side of the metal bar 7 that is away from the side of the metal bar 7 on which the final half 3 or 4 of the column 1 is to be installed. Subsequent movement of the final half 3 or 4 of the column 1 in the direction which the end of the metal projection 8 that is not embedded within such half 3 or 4 turns, causes such half 3 or 4 to assume its desired position and enables the end of the metal projection 8 that is not embedded with the half 3 or 4 frictionally to retain such half 3 or 4 in such desired position until concrete is poured within the resultant column 1, which pouring is the next step in creating the fence.

Figure 4:
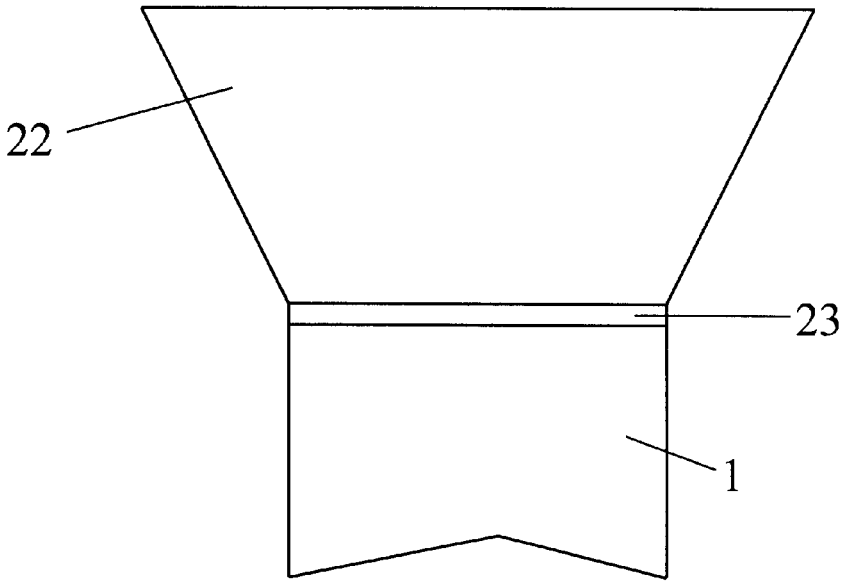
FIG. 4 shows an optional embodiment for the top of a column.

Primarily for decorative purposes, a cap 22 is then, as can be seen in FIG. 4, optionally placed on the top of the column 1, which top is of course the end of the column 1 which is to be directed away from the earth after the column 1 has been installed. Preferably, the first half 3 and the second half 4 of the column 1 are, when installed, slightly farther from the earth than are the panels 2. This allows the cap 22 to avoid being tilted if the panels 2 that extend into the column 1 are not precisely aligned with one another. The cap 22 is preferably attached to the column 1, and such attachment is preferably done with epoxy. If desired, a watertight seal 23 can optionally, as portrayed in FIG. 4, be placed between the cap 22 and the combined first half 3, second half 4, and panels 2.

A column 1 at which the direction of the fence changes is constructed basically the same as a column 1 at which the fence continues its original direction. There are, however, two alternative columns 1.

Figure 5:
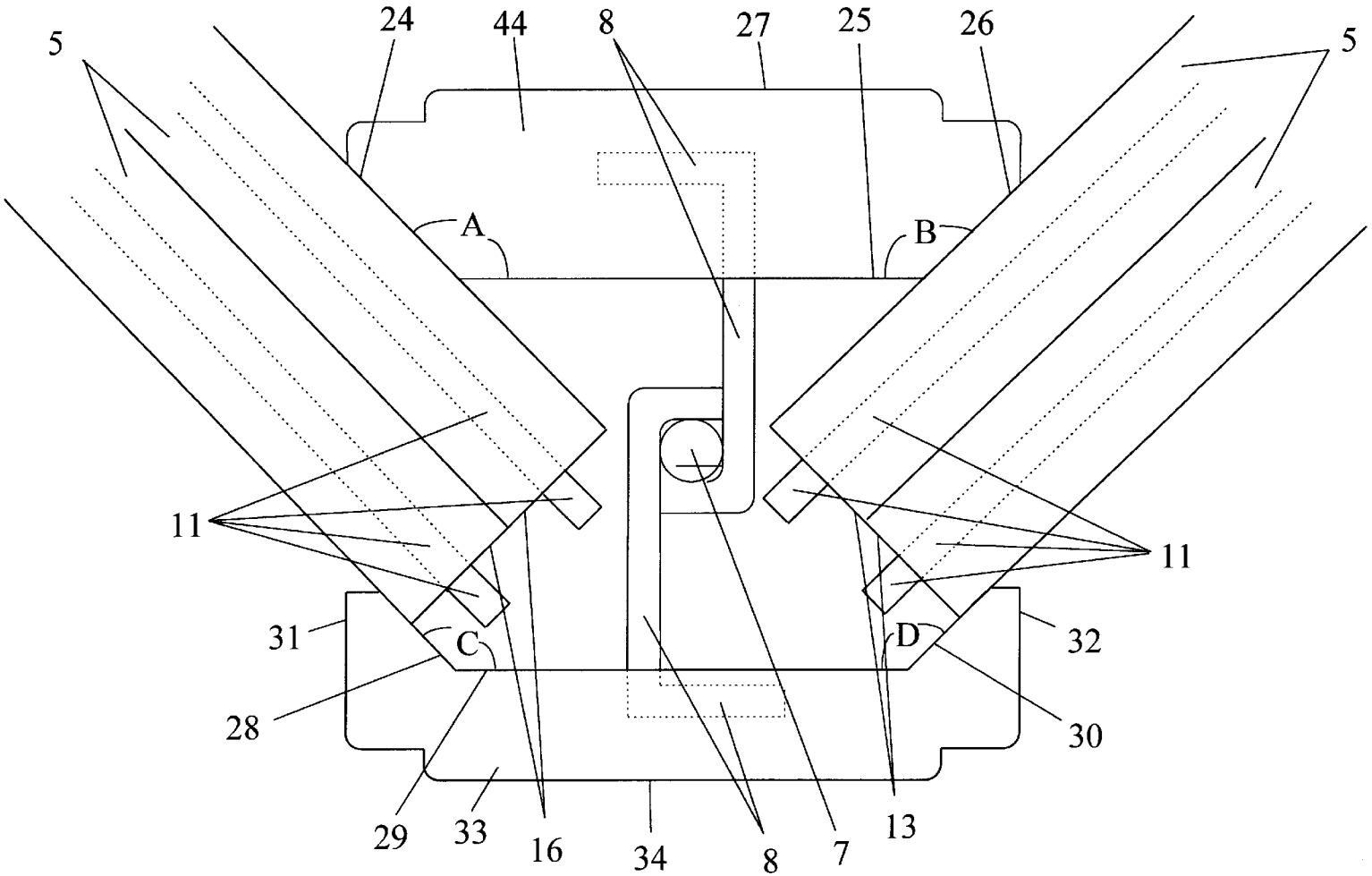
FIG. 5 portrays a first option for a column at a corner of the Column and Panel Concrete Fence.

The first option for a column 1 at a corner of the fence has the fewest modifications to the column 1 used where the fence does not change direction. As depicted in FIG. 5, the acute half 44 of such a column 1, i.e., the portion of the column 1 which is to be situated in the acute angle formed by the panels 2 has its first corner 24 on its inner face 25, which inner face 25 will be directed toward the metal bar 7, formed at approximately the same angle A, with respect to inner face 25, as is desired for the panel 2 which will be adjacent to such first corner 24 to have with respect to such inner face 25 and, similarly, has its second corner 26 on its inner face 25 formed at approximately the same angle B, with respect to inner face 25, as is desired for the panel 2 which will be adjacent to such second corner 26 to have with respect to such inner face 25. Preferably, although not necessarily, angle A will be the same as angle B. Also, preferably, the distance between inner face 25 and outer face 27 of acute half 44 will be the same as the corresponding distance for a second half 4 of a column 1 where the fence does not change direction. If desired for additional structural strength, such distance could, however, be increased for acute half 44.

The obtuse half 33 of a column 1 at a corner of the fence is formed to have a first inner edge 28, which inner edge 28 creates, with respect to the inner face 29 of obtuse half 33, i.e., the portion of obtuse half 33 which will be directed toward the metal bar 7, approximately the same angle C as is desired for the panel 2 which will be adjacent to such inner edge 28 to make with respect to inner face 29 and to have a second inner edge 30, which inner edge 30 creates, with respect to the inner face 29 approximately the same angle D as is desired for the panel 2 which will be adjacent to such inner edge 30 to make with respect to inner face 29. As depicted in FIG. 5, inner edge 28 does not reach a first end 31 of obtuse half 33; and inner edge 30 does not reach a second end 32 of obtuse half 33. In an optional embodiment (nor illustrated), however, inner edge 28 reaches the first end 31 of obtuse half 33; and inner edge 30 reaches the second end 32 of obtuse half 33. Preferably, although not necessarily, angle C will be the same as angle D. And, also, preferably, inner edge 28 and inner edge 30 are formed by reducing the distance between inner face 29 and outer face 34 of obtuse half 33; however, an optional embodiment (not illustrated) is produced by extended the first end 31 and the second end 32 of obtuse half 33.

Figure 6:
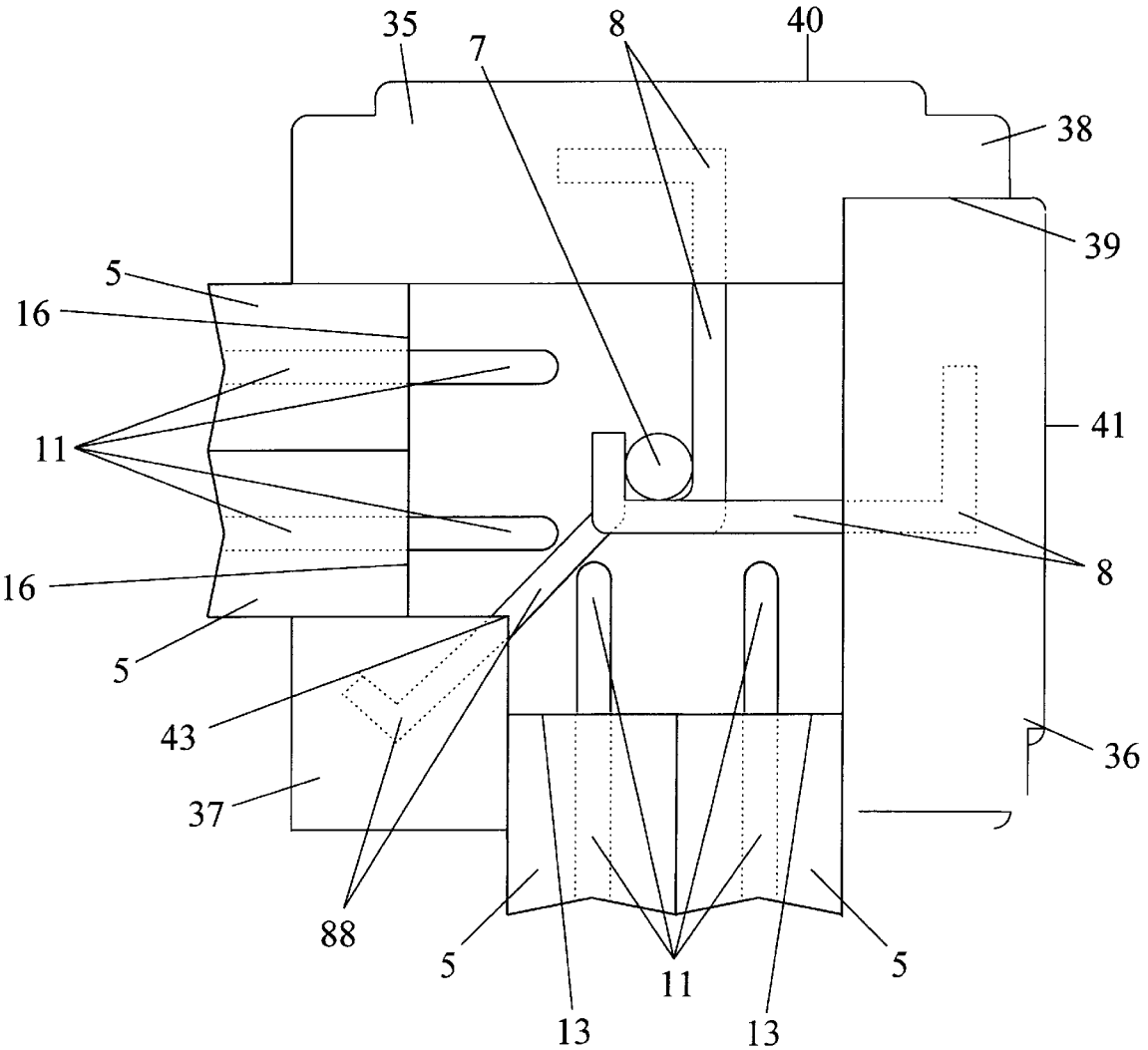
FIG. 6 depicts a second option for a corner where the Column and Panel Concrete Fence makes a right angle.

While the first option for a column 1 can be used to make any desired angle with the fence, the second option for a column 1 at a corner of the fence is exclusively for a corner where the fence makes a right angle and causes two panel units 5 to enter the column 1 at a right angle with respect to one another, as illustrated in FIG. 6.

This second option for a column 1 at a corner of the fence has three primary components, viz., a first outside wall 35, a second outside wall 36, and an inside wall 37.

The first outside wall 35 and the second outside wall 36 are constructed essentially the same as the standard first half 3 and second half 4 of a column 1 for a location where the fence does not change direction. The first outside wall 35 and the second outside wall 36 are installed so that they touch one another and are at right angles to one another. For aesthetic reasons, a first end 38 of the first outside wall 35 and a first end 39 of the second outside wall 36 are modified in any manner, one of which is shown in FIG. 6, so that resultant column 1 will have a first outside face 40 and a second outside face 41 with the same appearance as the outside face 42 of the second half 4 of a column 1 which is used at a location where the fence does not change direction.

The inside wall 37 preferably has a square cross section and one or more metal projections 88 extending from the inside wall 37, preferably through the inside corner 43 of such inside wall 37. Unlike the metal projections 8, the end of metal projection 88 which is not embedded within inside wall 37 is not preferably turned approximately perpendicularly to the body of the metal projection 88.

Generally, either the first outside wall 35 or the second outside wall 36 is placed on a footing 6 and its metal projections 8 are attached, preferably by spot welding, to the metal bar 7; with the particular shapes depicted in FIG. 6 for the first outside wall 35 and the second outside wall 36, however, the first outside wall 35 must first be placed on a footing 6 and have its metal projections attached to the metal bar 7. The inside wall 37 is then placed on a footing 6, and the metal projections 8 are subsequently attached, for example, with clamps or by spot welding, to the metal bar 7 rising form the footing 6. Finally, the second outside wall 36 is installed on column 1 in precisely the same manner as described above for the second half 3 or 4 on a column 1 at a location where the fence does not change direction; and the subsequent steps in the installation of a column 1 where the panels 2 make a right angle with respect to one another are identical to those enumerated above for a column 1 at a location where the fence does not change direction.

Figure 7:
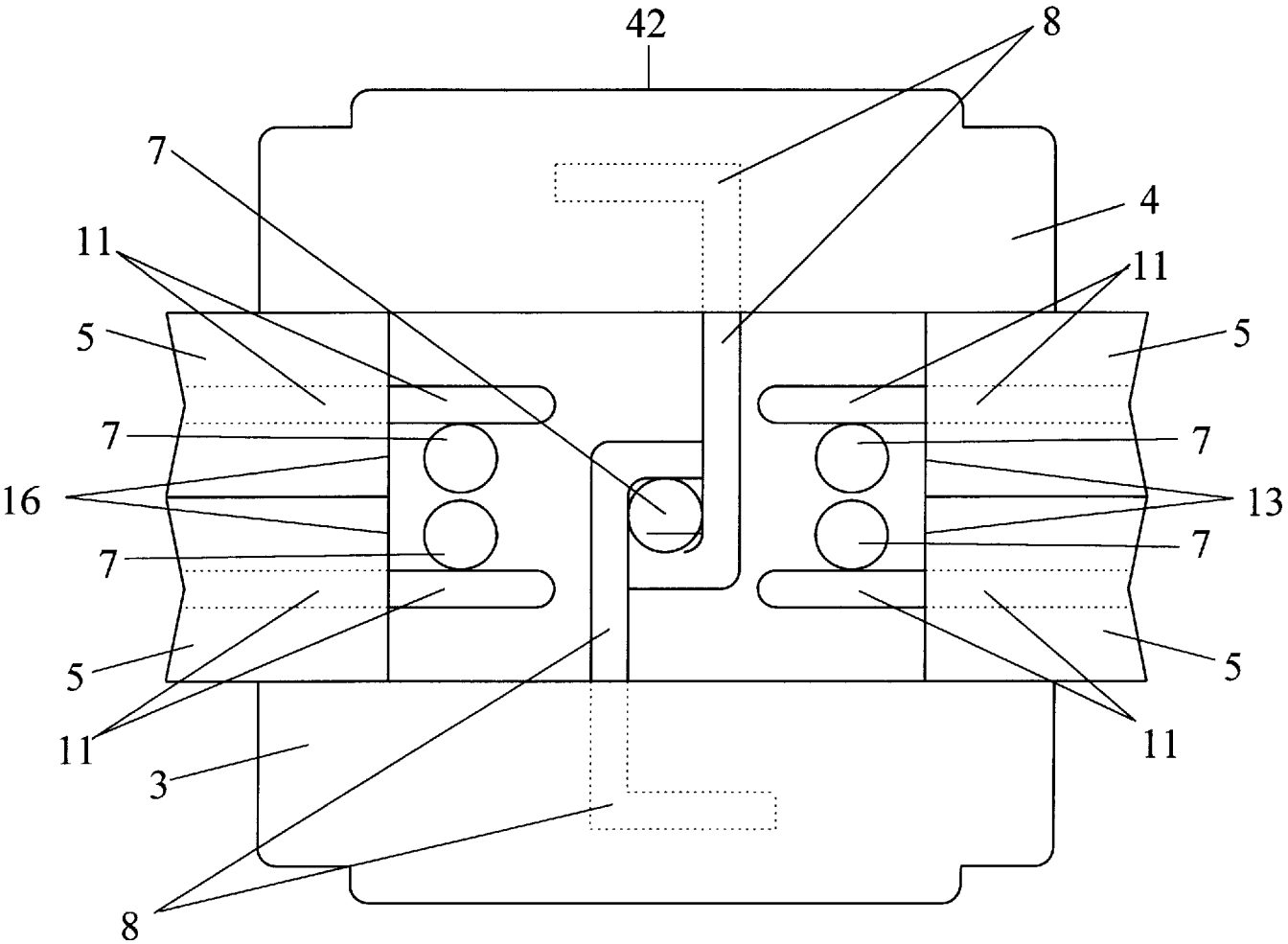
FIG. 7 demonstrates how the rod extending from the panel is connected to a metal bar rising from the footing to assure compliance with seismic building codes.
Figure 8:
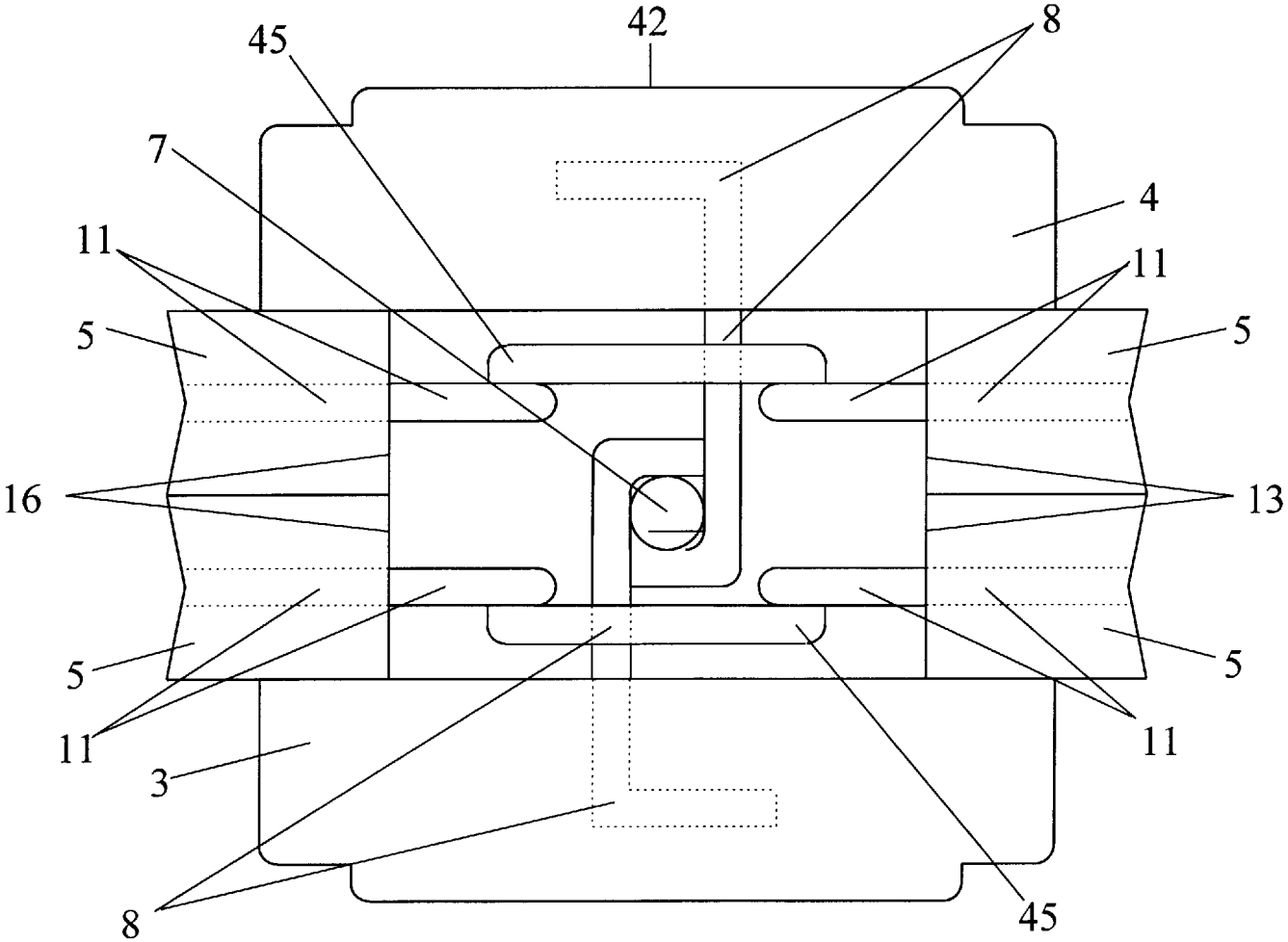
FIG. 8 illustrates one method for attaching a rod extending from one panel to a rod extending from an adjacent panel.

To assure compliance with seismic building codes, the rod 11 of the panel 2 can be connected, preferably by spot welding, either to a metal bar 7 rising from the footing 6, as depicted in FIG. 7, or to a metal pin 45 that is similarly attached to the rod 11 of the panel 2 that is aligned with the rod 11 of the first panel 2 but on the opposite side of the column 1 from the rod 11 of the first panel 2, as illustrated in FIG. 8.

I claim:

1. A column and panel concrete fence, which comprises:

two or more concrete footings;

a concrete column placed atop and attached to each footing, each of said columns comprising two portions which are separated from one another along one or more planes that are essentially parallel to the longitudinal axis of the column; and a concrete panel, a first end of said panel being placed atop one of said footings such that the first end of said panel extends between the portions of the column placed atop said footing and a second end of said panel being placed atop another of said footings such that the second end of said panel extends between the portions of the column placed atop said other footing.

2. The column and panel concrete fence as recited in claim 1, further comprising:

a metal bar bound within and rising from each footing.

3. The column and panel concrete fence as recited in claim 2, wherein:

a rod is imbedded within such panel and extends from both a first end and a second end of such panel.

4. The column and panel concrete fence as recited in claim 3, wherein:

the rod extending from the panel is connected to the metal bar rising from the footing.

5. The column and panel concrete fence as recited in claim 3, wherein:

the rod extending from the panel is attached to the rod of a panel that is aligned with the rod of the first panel but on the opposite side of the column from the rod of the first panel.

6. The column and panel concrete fence as recited in claim 1, wherein:

said panel comprises two panel units.

7. The column and panel concrete fence as recited in claim 6, further comprising:

a metal bar bound within and rising from each footing.

8. The column and panel concrete fence as recited in claim 7, wherein:

a rod is imbedded within such panel and extends from both a first end and a second end of such panel.

9. The column and panel concrete fence as recited in claim 8, wherein:

the rod extending from the panel is connected to the metal bar rising from the footing.

10. The column and panel concrete fence as recited in claim 8, wherein:

the rod extending from the panel is attached to the rod of a panel that is aligned with the rod of the first panel but on the opposite side of the column from the rod of the first panel.

11. The column and panel concrete fence as recited in claim 1, further comprising:

additional concrete poured into said column to fasten said column to the footing on which said column has been placed, to fasten said panel to said column, and to fasten said panel to the footing on which said column has been placed.

* * * * *